US007117958B2

(12) United States Patent
Fanuel et al.

(10) Patent No.: US 7,117,958 B2
(45) Date of Patent: Oct. 10, 2006

(54) ONE-STEP DIRECTIONAL CORING OR DRILLING SYSTEM

(75) Inventors: Philippe R. Fanuel, Brussels (BE); Luis E. Quintana, Brussels (BE); Olivier Mageren, Gilly (BE)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 11/089,912

(22) Filed: Mar. 25, 2005

(65) Prior Publication Data

US 2005/0167158 A1 Aug. 4, 2005

Related U.S. Application Data

(63) Continuation of application No. PCT/BE03/00161, filed on Sep. 25, 2003.

(30) Foreign Application Priority Data

Sep. 26, 2002 (BE) ..... 2002/0563

(51) Int. Cl.
*E21B 7/08* (2006.01)

(52) U.S. Cl. ..... 175/61; 175/82; 166/117.6

(58) Field of Classification Search ..... 175/61, 175/80, 81, 82; 166/117.5, 117.6
See application file for complete search history.

(56) References Cited

U.S. PATENT DOCUMENTS 3,123,160 A * 3/1964 Kammerer ..... 175/82
5,163,522 A 11/1992 Eaton et al. ..... 175/58
5,568,838 A 10/1996 Struthers et al. ..... 175/246
6,050,334 A 4/2000 McGarian et al. ..... 166/117.6
6,209,636 B1 * 4/2001 Roberts et al. ..... 166/117.6

FOREIGN PATENT DOCUMENTS

| | | |
|---|---|---|
| BE | 1011199 | 6/1999 |
| BE | 1011414 A3 | 9/1999 |
| EP | 0514657 A1 | 4/1992 |
| WO | WO9703274 | 1/1997 |
| WO | WO 2004/029401 A1 | 4/2004 |

OTHER PUBLICATIONS

International Search Report from PCT/BE03/00161, (3 pp), Jan. 23, 2004.
International Preliminary Examination Report from PCT/BE03/00161, (3 pp), Apr. 27, 2004.

* cited by examiner

*Primary Examiner*—William Neuder
(74) *Attorney, Agent, or Firm*—Baker Botts L.L.P.

(57) ABSTRACT

An assembly for sidetracked drilling in a wall of a borehole previously drilled or cored in a formation includes a guide element and an expansible device fixed to the front end of the guide element operable to be selectively expanded by an actuation means. A sidetracking channel is formed in the guide element in alignment with an internal space, upstream of the expansible device in the direction of advance. A longitudinal cavity is formed in the guide element parallel to the longitudinal axis and arranged to allow passage from the internal space to the actuation means of the expansible device. Within the internal space of the guide element, an external tube of the core barrel includes a core bit fixed to the front end of the external tube and arranged to slide, after having been released, in the internal space and in the sidetracking channel and then progress to the formation.

25 Claims, 15 Drawing Sheets

ONE-STEP DIRECTIONAL CORING OR DRILLING SYSTEM

CROSS REFERENCE TO RELATED APPLICATION

This application is a continuation of copending International Application No. PCT/BE/03/000161 filed Sep. 25, 2003, which designates the United States, and claims priority to Belgium application No. 2002/0563 filed Sep. 26, 2002.

TECHNICAL FIELD

The present invention concerns an assembly intended for sidetracked coring or drilling in a wall of a borehole previously drilled or cored in a formation.

BACKGROUND OF THE INVENTION

There exist many assemblies intended for directional coring and drilling but those which are known at the present time require a prior operation of fitting the guidance or sidetracking element, separately from the operation of lowering the core barrel and using the latter. This succession of operations takes a great deal of time which, as is known, is very expensive in this industry because of the particular specialization of the individuals practicing it, the risks which they run, the dedicated equipment used, the technical complexity of the operations which have to be performed, etc. There are also the risks of losing expensive equipment in the ground in each lowering and raising operation and, often because of this, also losing access to the borehole.

SUMMARY OF THE INVENTION

An expansible device, fixed to the front end of the guidance element, has an external lateral surface which, in an idle state, has a transverse section less than that of the borehole and which is arranged to take, in an expanded state of the device, an immobilization abutment of the said assembly against the wall of the borehole. The expansible device comprises selective actuation means arranged to receive a pressurized fluid which causes an expansion of the expansible device beyond a given pressure of fluid, and a valve arranged so as to automatically oppose a discharge of this fluid at a given pressure out of the said actuation means.

A sidetracking channel is hollowed out in the guidance element in line with the internal space, upstream of the expansible element in the said direction of advancement. The sidetracking channel has a posterior end coaxial with the said internal space, a base and lateral sides which, from this posterior end of the channel and in the direction of the expansible device, follow a direction inclined with respect to the longitudinal axis of the guidance element, the base intercepting this axis. The channel extends until it opens out entirely from the guidance element, on the other side of the longitudinal axis, at a angle with respect to the above mentioned wall which is chosen for the sidetracked coring. The sidetracking channel has a transverse section adapted so that it can pass the said guided core barrel through the base and sides.

A longitudinal cavity is cut in the guidance element parallel to the aforementioned longitudinal axis and is arranged so as to allow passage from the above mentioned internal space as far as the means of actuating the expansible device.

In the internal space of the guidance element, possibly even in a posterior portion of the sidetracking channel, an external tube of the above mentioned core drill is arranged. This external tube has a coring bit fixed to the front end of this external tube, is to be suspended from a string and is locked in a releasable manner in the guidance element, in particular so that the bit is included inside an imaginary external envelope of the guidance element. The external tube is arranged so as to be able to slide, after having been released, in the internal space and in the sidetracking channel and then progress in the formation.

In the external tube of the core barrel, disposed temporarily so as to actuate the expansible device, a removable tubing is mounted which extends from the inside of this external tube, through the longitudinal cavity, as far as the selective actuation means. The removable tubing comprises a posterior end open so as to allow pressurized fluid to pass coming from the drill string. An attachment piece is fixed to this posterior end and is arranged for subsequent withdrawal of the tubing out of the above mentioned assembly. A front end of the said tubing is arranged for a releasable sealed connection between the tubing and the selective actuation means with a view to communicating the pressurized fluid to these, through the said tubing.

In this same external tube, after having expanded the expansible device and having withdrawn the said tubing out of the assembly, it is possible to dispose either an internal core drill tube or a bit plug arranged so that the latter can carry out drilling, the internal tube or the bit top having an attachment piece fixed to its posterior end and arranged for its lowering and subsequent removal from the above mentioned assembly.

As can be understood by a person skilled in the art from a reading of the above, the assembly described above, thus assembled, is lowered in a block into the borehole and can be oriented so that the bit attacks the wall of the hole in the required direction. Only a simple exchange between the removable tubing and either the internal core barrel tube or the said drilling bit top must be effected before attacking the wall.

For their mutual fixing, the guidance element can comprise a sliding member and the expansible device can comprise a chamber in which the sliding member can slide between two stop positions, a position in which the sliding member closes an outlet passage for the fluid contained at the given pressure in the expanded expansible device and a position in which this member opens this discharge passage. This mounting makes it possible to allow the fluid to escape selectively at a required time out of the expansible element, so that the latter can be released from the immobilization with respect to the wall.

According to one embodiment of the invention, the tubing comprises through its wall an orifice, with several orifices at the same level. An annular piston, with an internal passage for the fluid, is mounted sealingly so as to slide in the tubing between a starting position upstream of the orifice or orifices in order to enable fluid to enter the tubing through these, and another stop position in which it closes off the orifice or orifices.

On the upstream side, the annular piston can comprise a valve seat adapted to receive a valve, preferably a bore, intended to close at least a large passage for the fluid in the tubing in the direction from upstream to downstream, and to leave this passage clear in the opposite direction. At least one bypass, with a transverse section reduced with respect to that of the said passage, can be arranged as a bypass for the valve seat and valve.

According to a particular embodiment, the assembly of the invention can comprise a known system for measuring the orientation in the ground of an object equipped with this system, this being able to be disposed under a guide nose or between the latter and the rest of the sidetracked coring or drilling assembly.

Thus the assembly according to the invention is particularly well suited in the case where a borehole has been drilled and where a logging of this hole has been carried out. According to the data collected by this logging, it may be wished to carry out a sidetracked drilling and/or coring from this hole in particular directions and at particular depths.

According to a particular embodiment of the invention, the actuation means are arranged so as to receive, as a pressurized fluid, a fluid of the drilling or coring fluid type. According to a particularly advantageous embodiment of the invention, the actuation means are arranged so as to receive, as a pressurized fluid, an expansion fluid pressurized by a fluid of the drilling or coring fluid type by means of a separation piston.

Other details and particularities of the invention will emerge from the secondary claims and the description of the drawings which accompany the present document and which illustrate, by way of non-limiting examples, particular embodiments of the assembly according to the invention. An assembly is depicted in sections on successive figures which, starting for example from the front end of the assembly, are to be put following one another, the top of one being followed by the bottom of the following one. The various figures are elevation views with, where applicable, partial axial breaks and/or cuts.

BRIEF DESCRIPTION OF THE DRAWINGS

For an assembly assembled in order to be lowered into a borehole, there are depicted in FIG. 1 a front end of an assembly according to the invention, comprising in particular an expansible device, FIG. 2 a following section comprising a guide element and its sidetracking channel, as well as a removable tubing, FIG. 3 a following section comprising the guide element, the said tubing, the bit and an external core barrel tube, FIG. 4 a following section of the guide element with the said tubing and the external tube, and FIG. 5 a following section comprising the posterior end of the guide element and tubing, as well as the external tube.

The same assembly assembled for sidetracked coring in the borehole, are depicted in FIG. 6 the front end of the assembly according to the invention, comprising in particular the expansible device, FIG. 7 the following section comprising the guide element and its sidetracking channel, FIG. 8 a following section comprising the guide element, the bit, an external tube and an internal core barrel tube, FIG. 9 a following section with the guide element and the external and internal core barrel tubes, and FIG. 10 a following section with the posterior end of the guide element and internal tube, the external tube being extended beyond the top of this figure.

Figure 12:
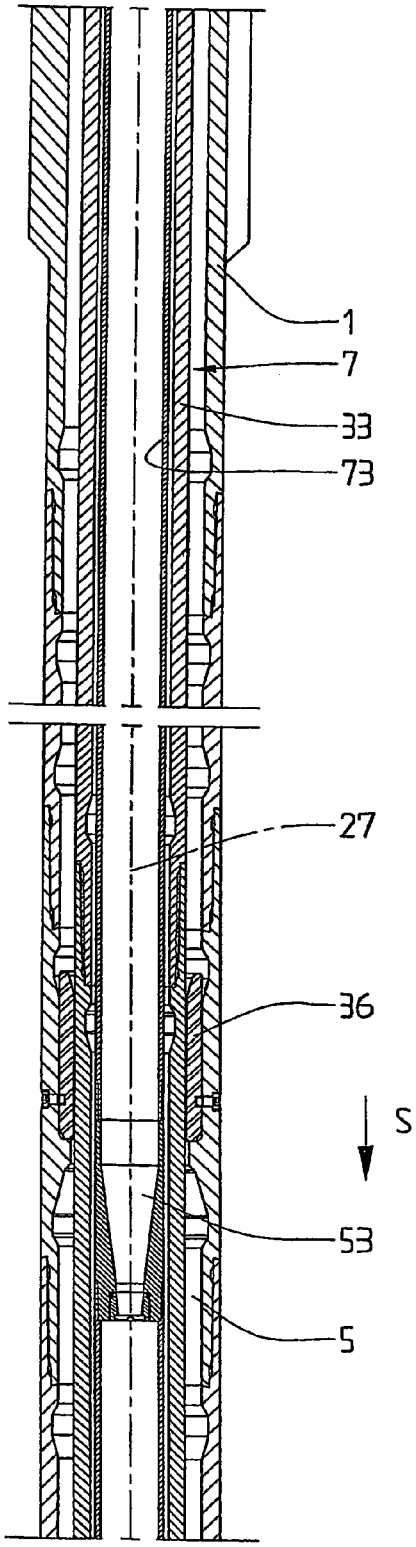
Figure 11:
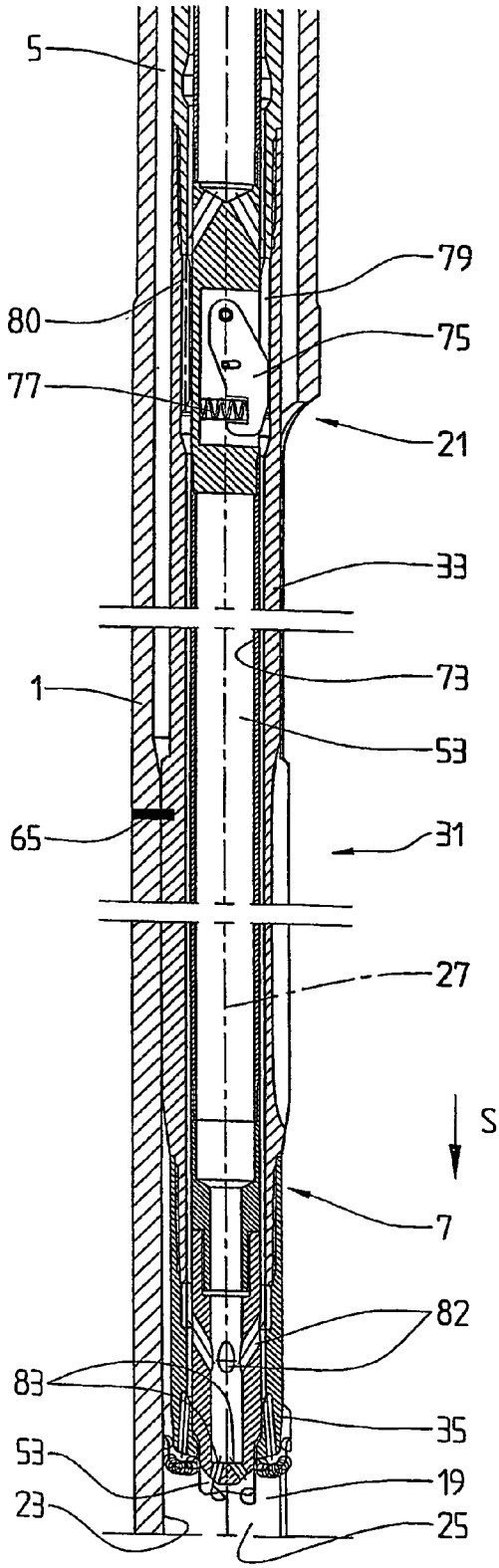
Figure 13:
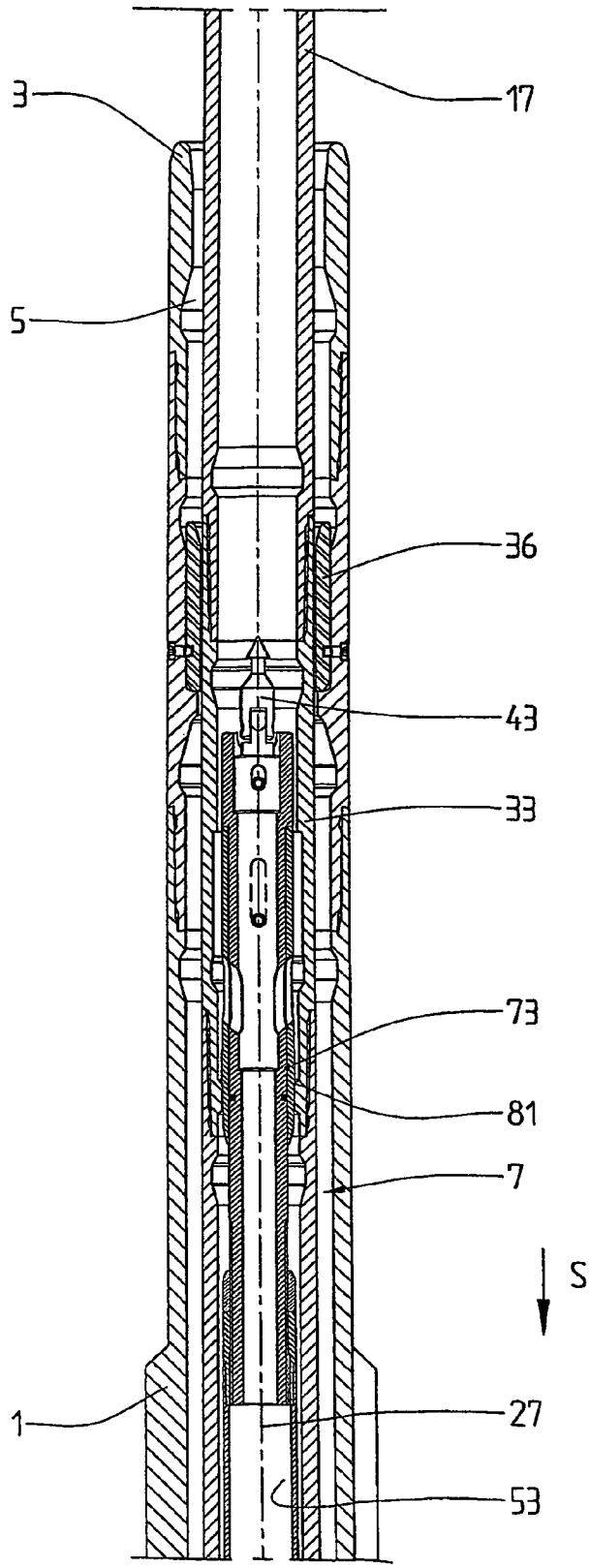

For the same assembly again, but for a sidetracked drilling in the borehole, there are depicted in FIG. 11 a section with the guide element and the front end of the core barrel equipped with a drill bit top instead of an internal tube, FIG. 12 a following section with the guide element, the external tube and a bar extending the said bit top, and FIG. 13 a following section with the posterior end of the guide element and extension bar.

Figure 3:
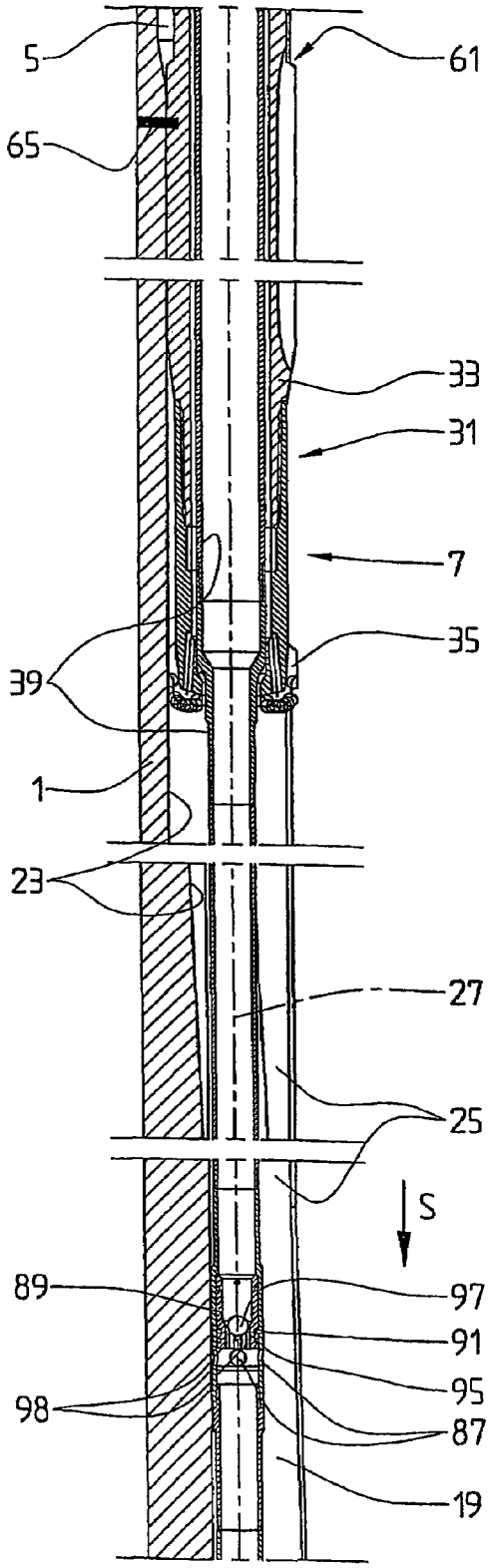
Figure 5:
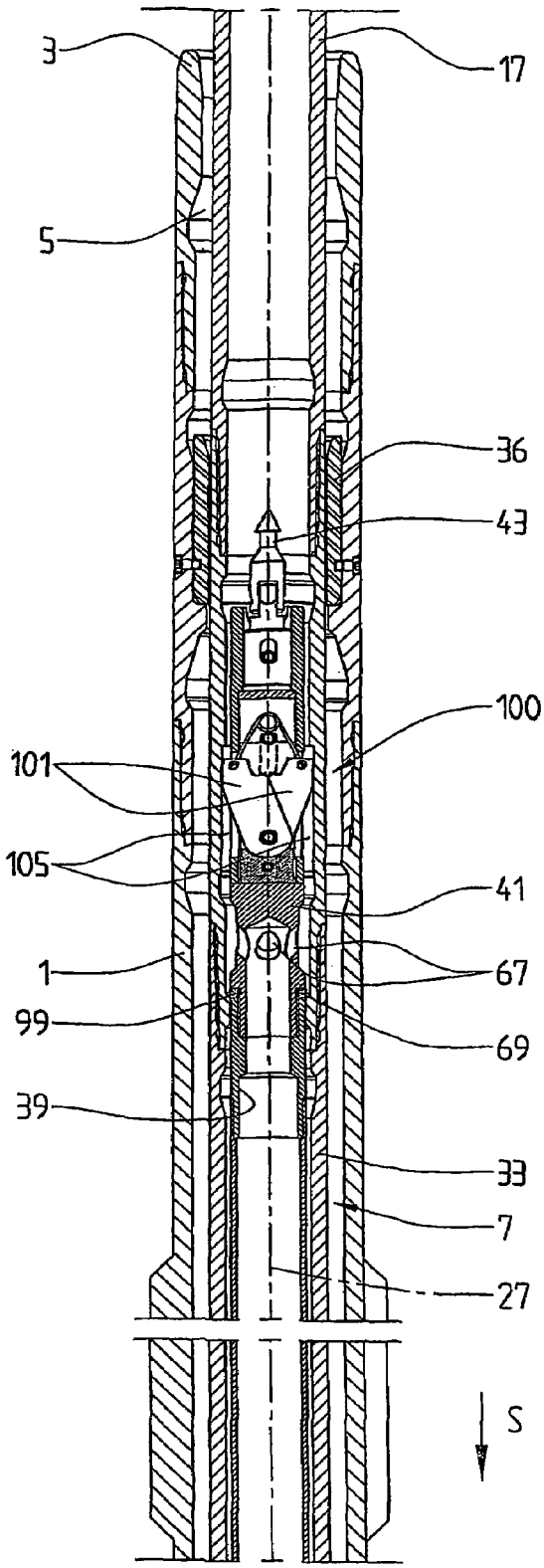
Figure 7:
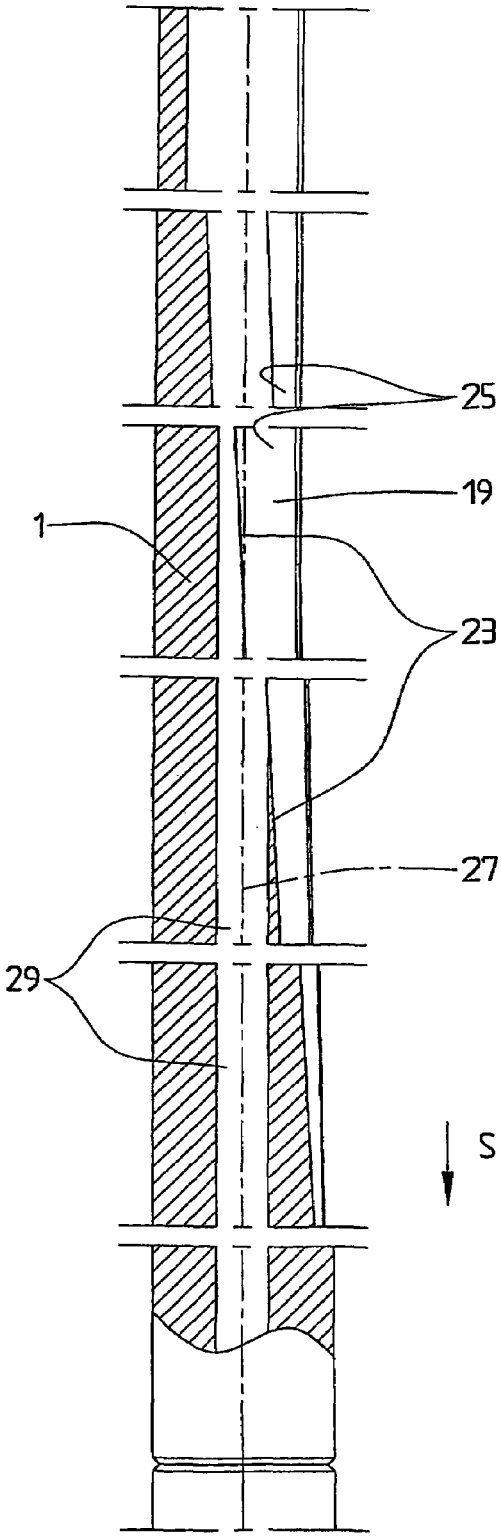
Figure 14:
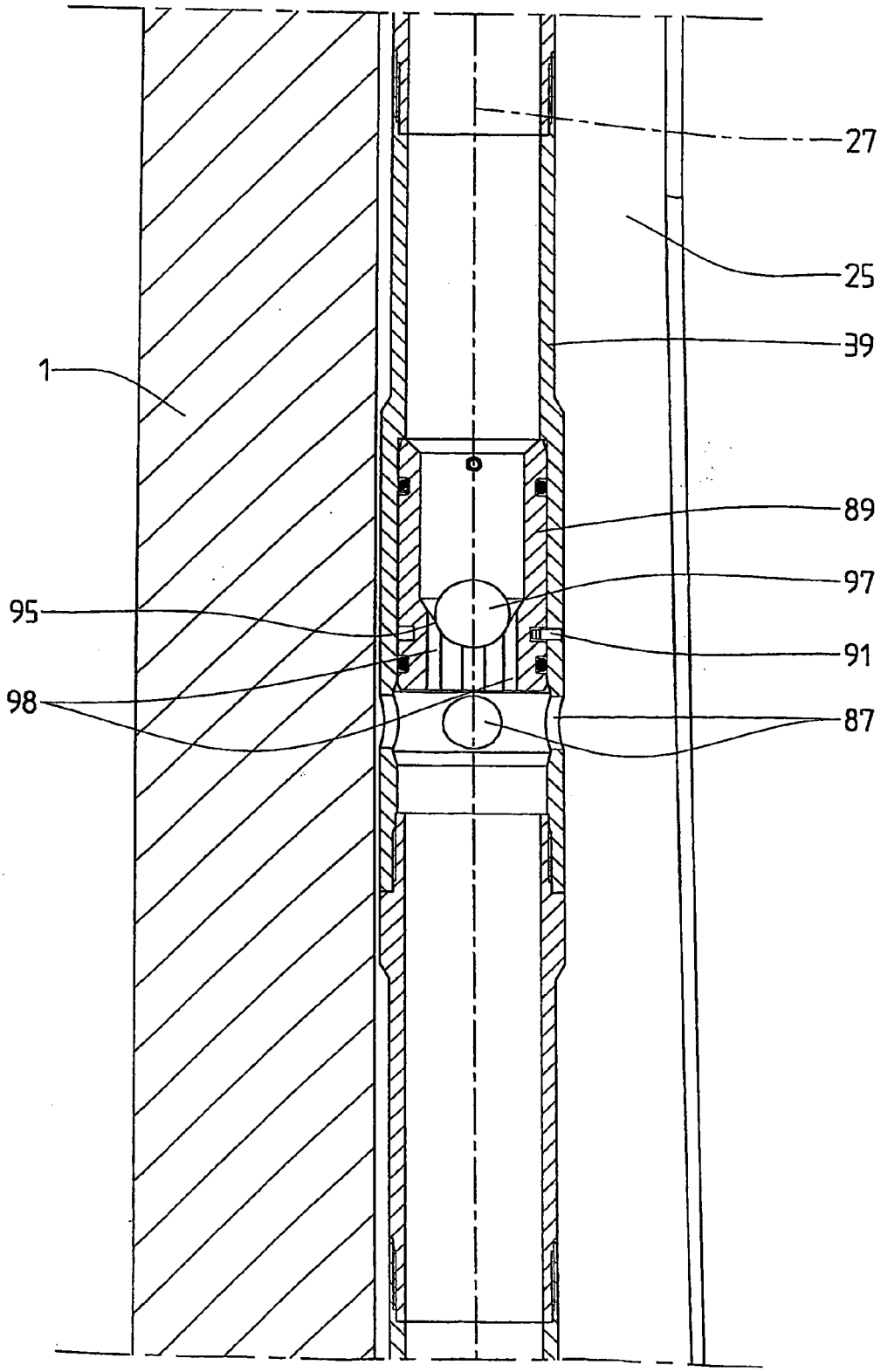

FIG. 14 shows, in a view similar to that in FIG. 3 but to a larger scale, an arrangement of a piston sliding in the removable tubing.

FIGS. 15 to 18 depict a variant embodiment according to the invention of an assembly intended for sidetracked coring or drilling, in a position on the surface, before lowering into the borehole.

FIGS. 19 to 22 depict this variant in the inflation position of the expansible device.

FIGS. 23 to 26 depict this variant after deflation of the expansible device.

DETAILED DESCRIPTION OF THE INVENTION

In the various figures, the same reference notations designate identical or similar elements.

According to the invention, the sidetracked coring or drilling assembly comprises (FIGS. 1 to 5) a guide element 1 whose outside diameter is chosen so as to be able to enter the borehole (not shown) to a depth required for the sidetracked coring. The guide element 1 has, from a posterior end 3, in a direction of advance S of the coring or drilling towards the bottom of the borehole, a coaxial internal space 5 with a diameter adapted to house a core barrel 7 therein.

An expansible device 9 is fixed to the front end 11 of the guide element 1 and has an external lateral surface 13 which, in an idle state (depicted in FIG. 1), has a transverse section less than that of the borehole and which is arranged so as to adopt, in an expanded state of the device 9, an immobilization abutment against the wall of the borehole. The expansible device 9 comprises selective actuation means 15 which are arranged to receive a pressurized fluid which causes an expansion of the expansible device 9 beyond a given pressure. The expansible device 9 also comprises a retaining valve (not shown in this embodiment) arranged to automatically oppose a discharge of this fluid at a given pressure from the actuation means 15. The pressurized fluid can in particular be a coring/drilling fluid, known in the art, brought to there through the drill string 17 (FIG. 5), to which the above mentioned assembly is connected during use.

The expansible device 9 can comprise, for the above mentioned immobilization abutment, a sleeve 18 made from impermeable elastic material arranged, in the said device 9, so as to be able to be inflated by the aforementioned pressurized fluid and thus to bear firmly against the wall of the borehole. When the pressure is released, the sleeve 18 can then resume its initial shape and release its immobilization abutment.

A sidetracking channel 19 is hollowed in the guide element 1 in extension to and downstream of the internal space 5, upstream of the expansible device 9 in the direction of advance s. The sidetracking channel 19, a posterior end 21 of which is coaxial with the said internal space 5, has a base 23 and two lateral sides 25 which, from this posterior end 21 and in the direction of the expansible device 9, follow a direction inclined with respect to the longitudinal axis 27 of the guide element 1. The said base 23 intersects this axis 27. The channel 19 extends until it entirely opens out from the guide element 1, on the other side of the longitudinal axis 27, at a angle with respect to the above mentioned wall which is chosen for the sidetracked coring. The sidetracking channel 19 has a transverse channel adapted so that the said core barrel 7 guided by the base 23 and the sides 25 can pass therein.

A longitudinal cavity 29 is cut in the guide element 1, parallel to the aforementioned longitudinal axis 27, and is arranged so as to allow passage from the above mentioned internal space 5 as far as the actuation means 15 for the expansible device 9. This longitudinal cavity 29 and the guide element 1 are preferably coaxial.

In the internal space 5 of the guide element 1, possibly even in a posterior portion 31 of the sidetracking channel 19, an external tube 33 of the above mentioned core barrel 7 is arranged. This external tube 33 comprises a core bit 35 fixed to the front end of the external tube 33, is to be suspended from a drill string 17, and is locked releasably in the guide element 1, in particular so that the bit 35 is included inside an imaginary external envelope of the guide element 1. The external tube 33 can be carried (FIGS. 4 and 5) by two bearing sleeves 36 so as to be able, after having been released, to turn and slide in the internal space 5 and in the sidetracking channel 19 and then be able to progress in the formation.

In the external tube 33 of the core barrel 7, in order to actuate the expansible device 9, there is temporarily disposed a removable tubing 39 which extends from the inside of this external tube 33, through the longitudinal cavity 29, as far as the selective actuation means 15. The removable tubing 39 comprises a posterior end 41 open so as to allow the pressurized fluid coming from the drill string 17 to pass therein. An attachment piece 43 is fixed to this posterior end 41 and is arranged for subsequent withdrawal of the tubing 39 out of the above mentioned assembly. A front 45 of the said tubing 39 is arranged for releasable sealed connection between the tubing 39 and the selective actuation means 15 with a view to communicating to the latter, through the said tubing 39, the aforementioned pressurized fluid. For example, the tubing 39 (FIG. 1) is pressed into a passage hole 47 in the expansible device 9, two O-ring seals 49 producing the seal between the tubing 39 and the said device 9.

Figure 9:
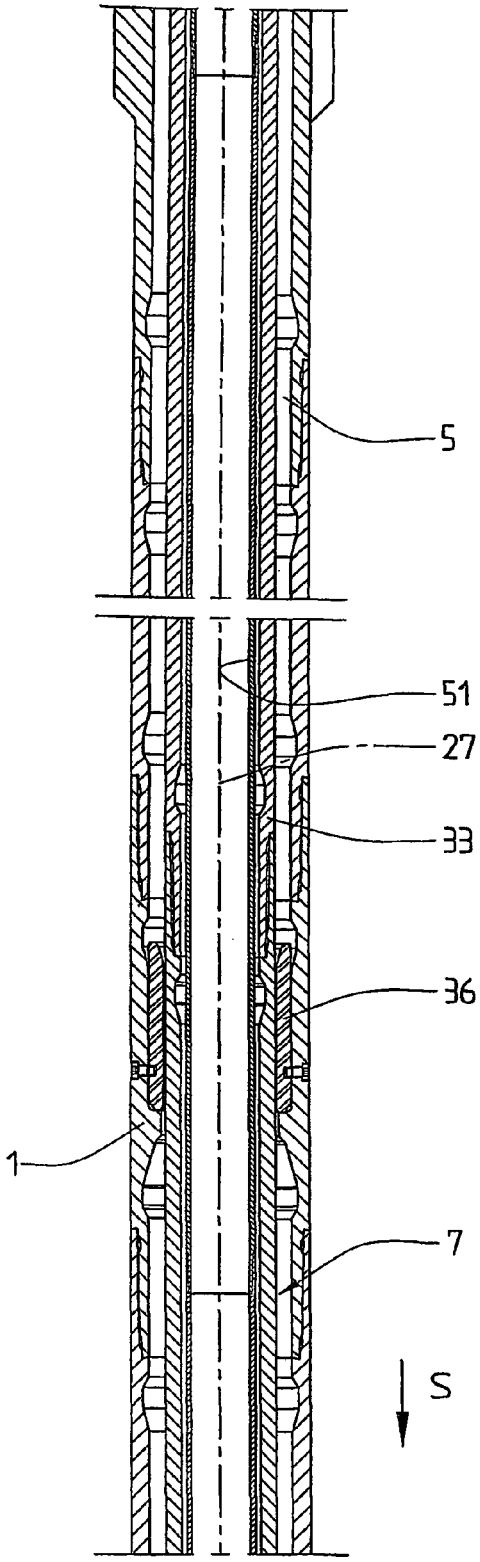
Figure 8:
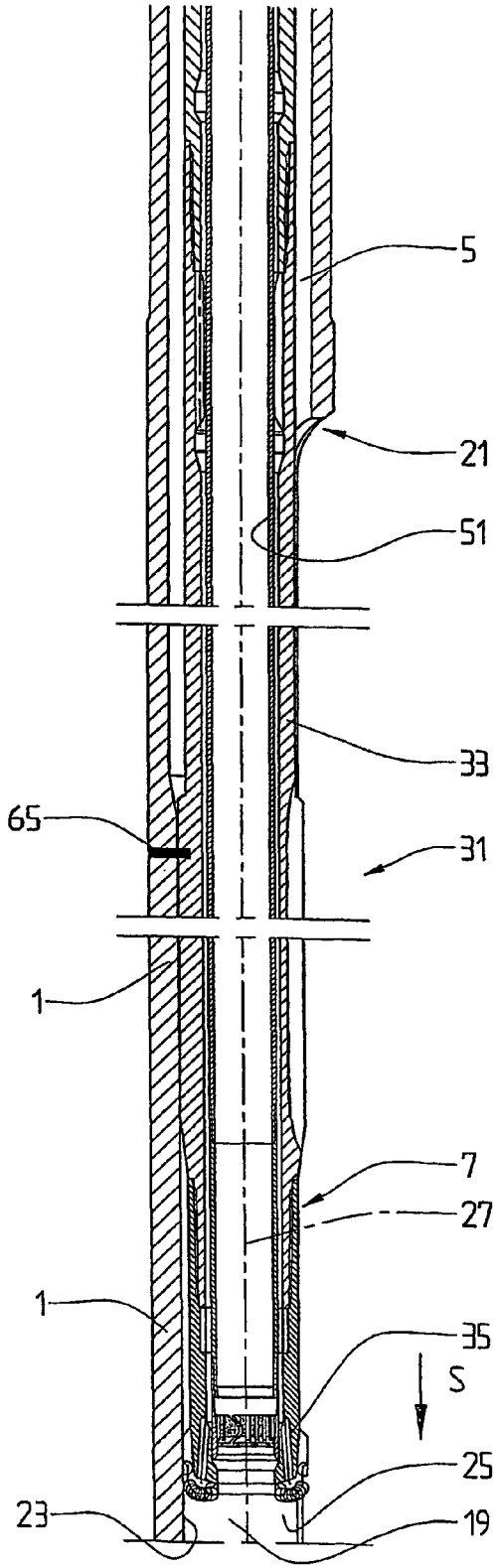
Figure 10:
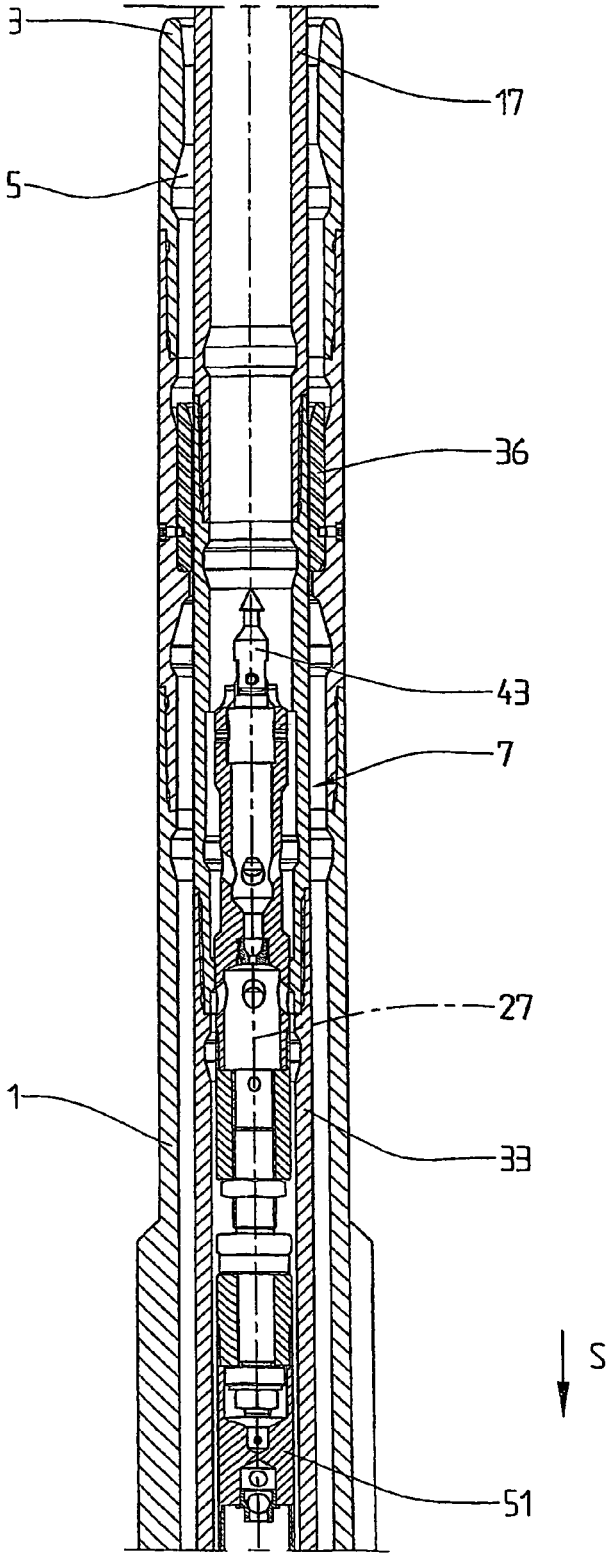

In this same external tube 33, having expanded the expansible device 9 and having withdrawn the said tubing 39 out of the assembly, it is possible to dispose either a normal internal tube 51 (FIGS. 8 to 10) for the core barrel 7 or a drill bit top 53 (FIGS. 11 to 13), which completes the bit 35 to form a drilling head. At its front end, which may project from the bit 35, the bit top 53 is then equipped with blades or abrasive elements. The internal tube 51 and the bit top 53 also each have an attachment piece 43 fixed each time to their posterior end and arranged for their descent into or subsequent withdrawal from the above mentioned assembly.

In order to fix them to each other, the guide element 1 can comprise (FIG. 1) a sliding member 55 and the expansible device 9 can comprise a chamber 57 in which the sliding member 55 is guided and can slide between two stop positions, a position (shown) in which the sliding member 55 closes an outlet passage 59 for the fluid contained at the given pressure in the expanded expansible device 9 and a position (not shown) in which this standing member 55 opens this outlet passage 59.

The external tube 33 can have an external abutment face 61 (FIG. 3) turned upstream and intended to cooperate with an internal stop face 63 (FIG. 4) which the guide element 1 has, which is turned downstream and against which the abutment face 61 can abut when the said external tube 33 is pulled out of the borehole.

In addition, the external tube 33 can advantageously be held fixed, in a releasable manner, in the guide element 1 by a pin 65 (FIG. 3) calibrated so as to break during a controlled rotation and/or translation movement of the external tube 33 in the guide element 1 fixed to the wall of the borehole by the expanded expansible device 9.

In order to be used, the sidetracked coring/drilling assembly which has just been described is first of all assembled, equipped with the removable tubing 39 according to FIGS. 1 to 5 and is fixed to a drill string 17 by means of the external tube 33. The assembly is then lowered into the borehole and turned if necessary (see below), by acting on the drill string 17, so that the sidetracking channel 19 has its opening in the direction in which it is wished to core or drill in a sidetracked manner. The fluid sent from the surface, through the drill string 17 (FIG. 5), passes into the external tube 33 and, through an annular space between this and the posterior end 41 of the tubing 39, this fluid arrives in the tubing 39 through openings 67 which are formed therein. A sealing ring 69 made from soft metal can be provided between the tubing 39 and the external tube 33 and prevents the said fluid from escaping from the path described. The fluid arrives (FIG. 1) at the front end 45 of the tubing 39 and, suitably pressurized, inflates the sleeve 18 so that the latter is firmly pressed against the wall of the borehole. When the pressure is then reduced, the retaining valve (not shown in this embodiment) prevents the sleeve 18 from deflating. The guide element 1 is thus immobilized in the borehole. The removable tubing 39 can then be withdrawn from the external tube 33, in a known manner referred to as "wire line" ("cable working") in the industry, by means of its attachment piece 43 through the drill string 17 as far as the surface.

If it is then wished to carry out coring, the internal tube 51 (FIGS. 7 to 10) can be loaded into position in the external tube 33 by the same "wire line" technique. The internal tube 51 can be held in place, stopped very close to or in the bit 35 by the pressure of the fluid sent into the assembly for coring purposes. In order to start the sidetracked coring, it is necessary first of all to break the releasable locking, in particular by making the external tube 33 turn by means of the drill string 17 in the guide element 1 fixed to the wall of the borehole, as explained above. This rotation, or a translation movement communicated to the external tube 33 with or without impact, breaks the pin 65 calibrated for this purpose. The controlled core barrel 7, driven in rotation and pushed by means of a drill string 17, is guided by the guide element 1 in order to attack the wall of the borehole at the planned angle.

If it is wished to carry out a sidetracked drilling in the adjusted direction, either before a sidetracked coring, or without consecutive coring, or after coring sidetracked in this direction, the said bit top 53 (FIGS. 11 to 13) is installed in the external tube 33 instead of the internal tube 51, using the same "wire line" technique. The said bit top 53 can comprise (FIG. 11), in a bar 73 which makes it up, a bolt 75 which is pushed home by a spring 77 in a position projecting out of the bar 73 and which can be pushed into a retracted position in the said bar 73 by an external action. The bolt 73 has, at each of its front and rear ends, an inclined face arranged so that, when the bit top 53 is introduced into the external tube 33 or is withdrawn therefrom, the said bolt 75 automatically retracts into the bar 73.

A longitudinal groove 79 is cut in the internal wall of the external tube 33 so as to be able to receive the bolt 75, which engages therein under the thrust of the spring 77. This may occur at the end of the descent of the bit top 53 in the external tube 33 when the bolt 75 is in line with the groove 79. Otherwise, when the bolt 75 and groove 79 are not aligned whilst the bit top 53 is in place in the core bit 35, this occurs because there is a relative rotation possible between the bit top 53 and external tube 33 as soon as these come into engagement with the material to be drilled. The cooperation of the bolt 75 and groove 79 causes the coordinated rotational driving of the drilling bit 53 by the external tube 33, which drives the core bit 35 in the same way.

It is possible to see (FIG. 11), at the level where the housing of the bolt 75 is situated, one or more longitudinal conduits 80 drilled in the wall of the external tube 33, parallel to the longitudinal axis 27 and open solely at their end so as to prevent the said bolt 75 being able to become attached thereto.

In the embodiment depicted, the bit top 53 is pushed longitudinally in abutment downstream, for example against an internal annular face 81 (FIG. 13) of the external tube 33, by the pressure of the drilling fluid which passes therein.

It will be noted in FIGS. 13 to 11 that the bar 73 may be hollow between the attachment piece 43 and the housing of the bolt 75 and comprise outlet housing orifices so that fluid can circulate therein from upstream to downstream. Another tubular section can be provided in the said bar 73 between the housing of the bolt 75 and the front end of the bit top 53. Passages 82 (FIG. 11) can be hollowed in the front end of the bit top 53 in order to bring, to front regulating nozzles 83 of the latter, fluid coming from the annular space provided between the drill bit top 53 and the external tube 33.

In one embodiment of the invention, the tubing 39 can comprise (FIGS. 3 and 14), through its wall, an orifice 87, or several orifices 87 at the same level. An annular piston 89, having an internal passage for the fluid, is then mounted sealingly so as to slide in the said tubing 39 between a starting position (depicted in FIGS. 3 and 14) upstream of the orifice or orifices 87, so as to enable fluid to enter through these into the tubing 39, and another position (not shown) stopped downstream, in which the same piston 89 closes the orifice or orifices 87, the fluid then being channeled through the annular piston 89.

Associated with the annular piston 89, a valve seat 95 is disposed so as to receive a valve 97. The latter may preferably be a ball 97 installed on assembly or to be launched through the drill string 17, and is intended to close off at least a large section of the passage for the fluid in the removable tubing 39 in the direction from upstream to downstream, and to leave this passage clear in the opposite direction. In order to provide the required reduced passage from upstream to downstream, there may be formed, for example in the valve seat 95, at least one bypass 98, with a transverse section reduced with respect to that of the said passage, which is arranged as a bypass for the valve seat 95 and valve 97.

When the assembly described above, comprising the said removable tubing 39, is lowered into the borehole, the fluid contained in this hole must be able to escape to the surface without causing a force capable of dislodging the tubing 39 from its position of mounting in the assembly. When the orifices 87 are open as shown, fluid can enter through these into the tubing 39 and go back up to the surface without excessively pushing the tubing 39 towards the surface. When the assembly is disposed in the sidetracked drilling/coring position, it suffices to give a pressure shock of a predicable value at the required moment for the annular piston 89 to be pushed from its starting position shown as far as its stopped position downstream, in which it closes off the orifices 87 in order to force the fluid to go as far as the selective actuation means 15 in order to inflate the sleeve 18.

Since the passage through the annular piston 89 has to be relatively large to allow the fluid to pass effectively from downstream to upstream as explained above, the above mentioned pressure surge intended to move this piston 89 may have to be excessively large, at an undesirable level. In order to obtain a movement of the annular piston 89 safely at a reasonable pressure, the above mentioned valve or ball 95 is used. It then closes off the said passage from upstream to downstream and offers the fluid a larger surface, so that the annular piston 89 is pushed effectively, by the combination with the ball 95, into its position of closure of the orifices 87. The bypass or bypasses 98 enable fluid to pass however from upstream to downstream in order to actuate the expansible device 9.

Advantageously, the annular piston 89 is kept in the starting position by the breakable element 91, such as a pin, calibrated to break at a thrust from the piston 89 subjected to a pressure beyond a given threshold.

It must be understood that the invention is in no way limited to the embodiments described and that many modifications can be made to these without departing from the scope of the claims.

Thus, in order to prevent a longitudinal movement of the removable tubing 39 in the external tube 33, there may be provided, for example on the upstream side on the tubing 39, a positioning stop 99 (FIG. 5), in particular combined with the ring 69, which can abut against a suitable surface provided in the external tube 33. It is also possible to adapt a releasable bolt 100, in particular with two slides 101, which is mounted on the tubing 39, where the two slide 101, formed accordingly, are automatically locked by the action of a spring 103 in longitudinal recesses 105 or other receptacles cut in the external tube 33. When there is a given traction on the said attachment piece 43 in order to withdraw the tubing 39 from the external tube 33, the two slides 101 are withdrawn from the recesses 105 in a known manner.

Figure 2:
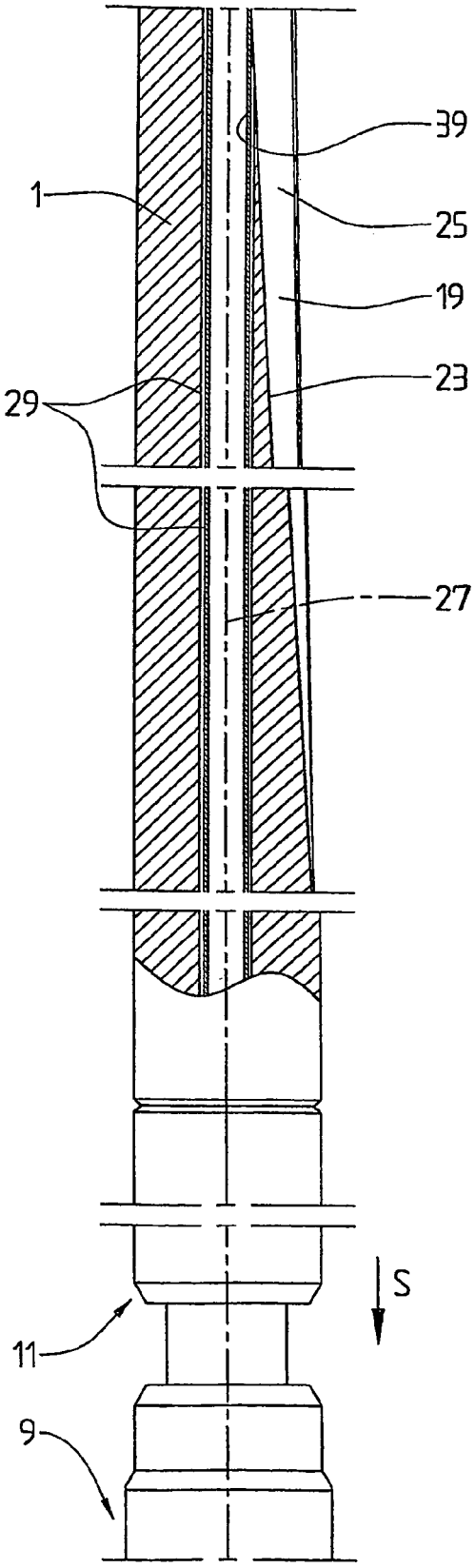
Figure 1:
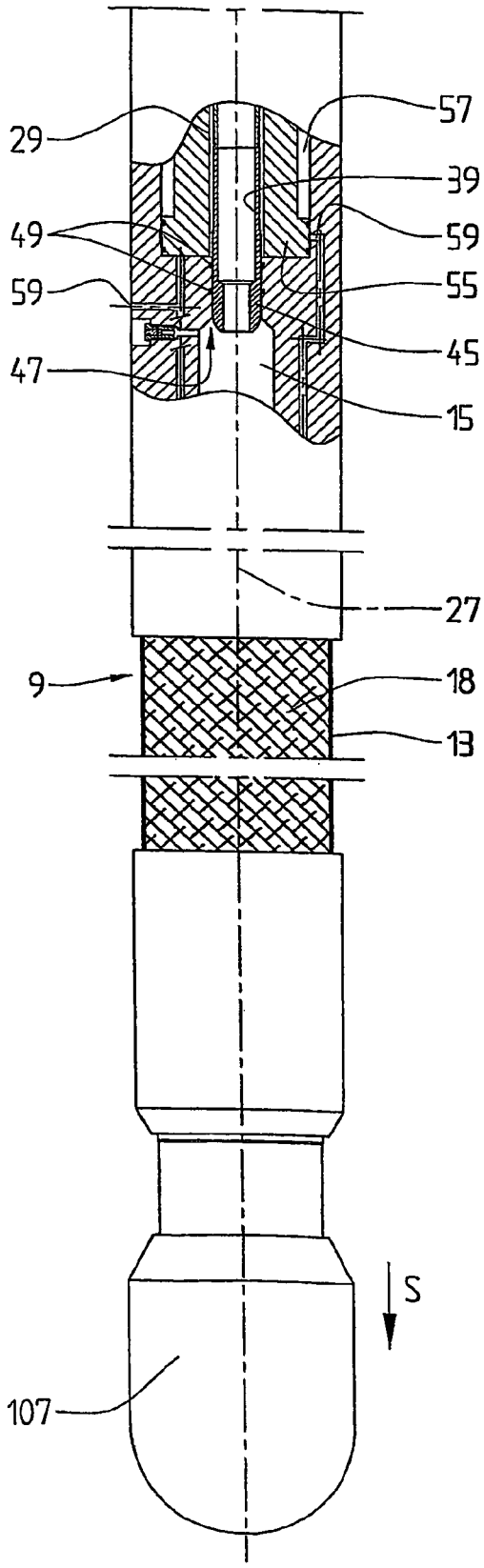
Figure 4:
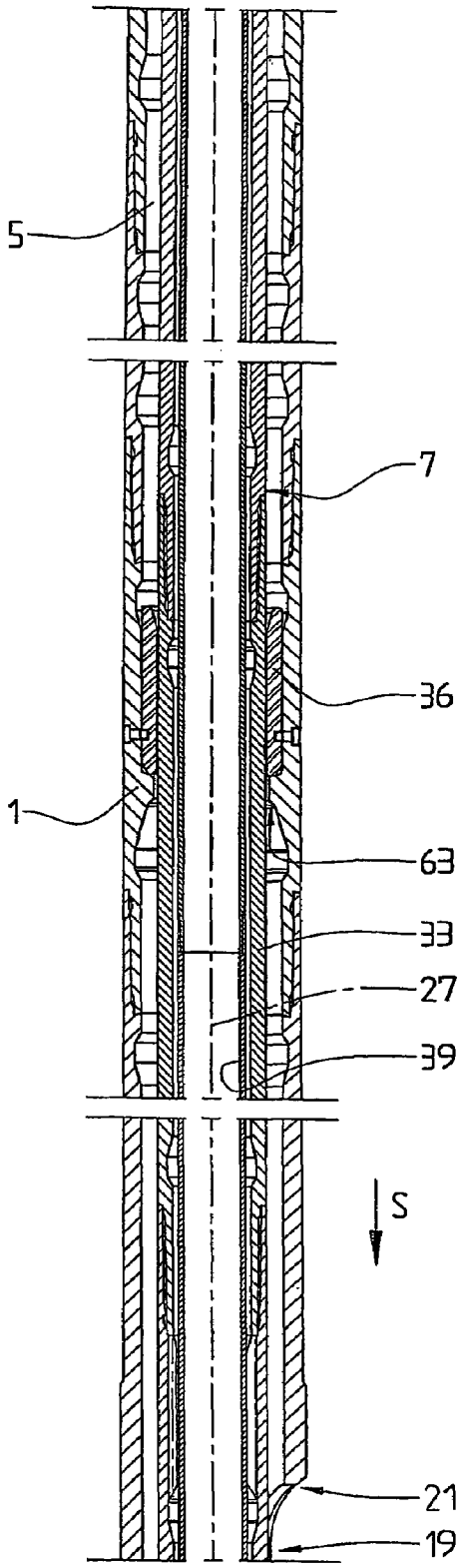
Figure 6:
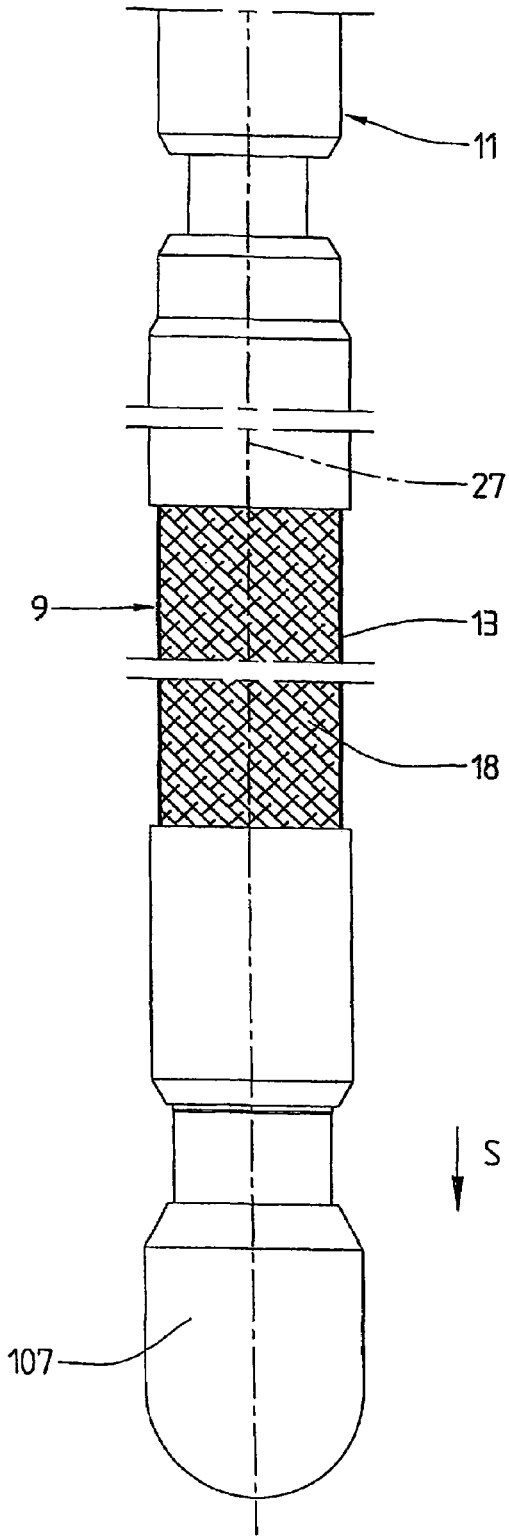

As shown by FIGS. 1 and 6, in front of the expansible device 9 a guide nose 107 can be arranged, the front end of which is preferably hemispherical.

A known system, not shown, for measuring the orientation in the ground of an object equipped with this system can interposed for example in the said guide nose 107 or between it and the rest of the sidetracked coring or drilling assembly. This measuring system can be of the type which records data, accessible then after having returned the said assembly and the system to the surface, or of the type which transmits orientation data in real time to an operator on the surface. According to the coring equipment used, the operator can possibly use these data transmitted in real time so as to act on the assembly and give it a particular orientation for drilling and/or coring.

In an other embodiment, the said orientation measuring system can be associated with the removable tubing 39, preferably at its posterior end 41. This system can be fixed thereto and is then raised only after the inflation of the elastic sleeve 18 and either it has transmitted in real time data on the orientation of the guide element 1 or these data are taken from the system once returned to the surface. According to these orientation data for the assembly as positioned in the borehole, any deviation with respect to a required orientation can be deduced therefrom and the orientation can be modified accordingly by acting on the drill string.

In yet another variant, the measuring system can be associated detachably with the posterior end 41 of the removable tubing 39 and be raised to the surface as many times as necessary, before inflating the elastic sleeve 18, in order to take the orientation information recorded therefrom and to check that the orientation of the assembly is correct or to correct it accordingly.

In either case, after having equipped the said assembly with the aforementioned system, and before lowering the whole into the borehole, a calibration of the said system can be carried out in order to unequivocally know its orientation with respect to that of the sidetracking channel 19 for example and to be able to adjust the orientation of this channel in a sure manner.

For the inflation operation, a particular fluid, without solid particles, may also be preferred in order to ensure faultless functioning of the non-return valve. This particular fluid could be sent under pressure through the drill string 17 or be stored in the above mentioned assembly and pressurized by means of a coring/drilling fluid acting in particular on a piston 20 for separating the two fluids.

A coring or drilling assembly allowing this functioning is illustrated in FIGS. 15 to 23.

In FIGS. 15 to 18, the assembly according to the invention is on the surface, before the descent into the borehole. The guide nose 107 of the this installation comprises a supply channel 108 which opens out at one end outside and can be closed there by a cock 109. In the position illustrated in FIG. 15, the cock 109 is opened, which allows a supply of particle-free fluid, for example water, into the channel 108, which communicates with an annular cavity 110, provided inside a support cylinder 111 of the expansible device 9. This annular cavity 110 in its turn communicates with a cylindrical cavity 112, in the upstream part of which, in the direction of descent of the drilling assembly, there is arranged a retaining valve [?]22. This valve comprises a first part 113 and second part 114 both capable of making a reciprocal sliding movement.

Figure 17:
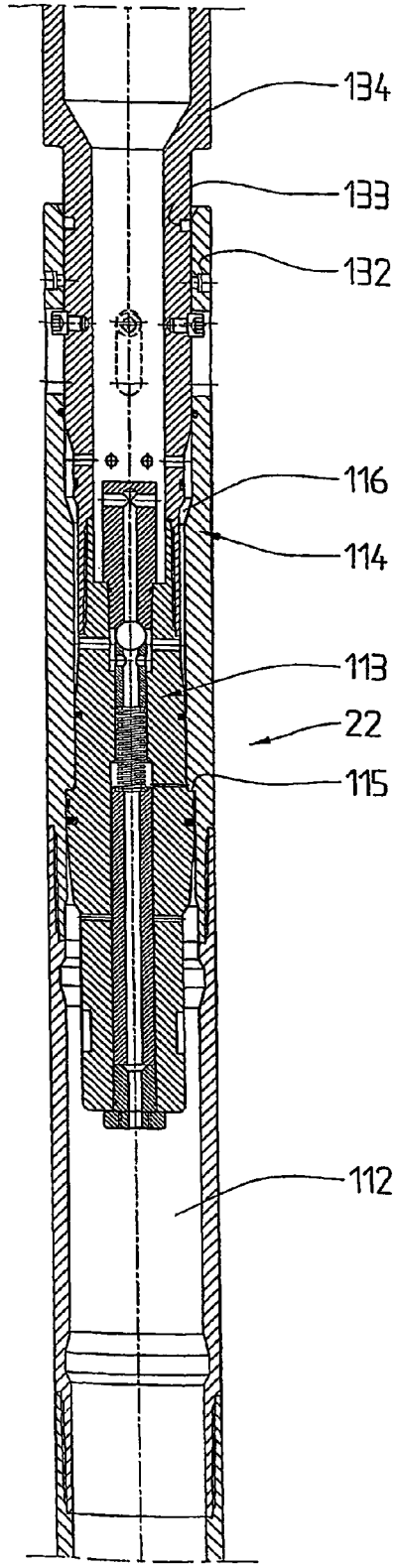

In the position illustrated in FIG. 17, the valve 22 is in the top position. The second part 114, under its own weight, bears on a seat 115 of the first part 113 and thus leaves clear an annular passage 116 between the first part 113 and the second part 114 of the valve 22. In this position, the valve 22 allows a passage of the fluid supplied from the cylindrical cavity 112 to the cylindrical chamber 117 in which the separation piston 20 is arranged.

Figure 18:
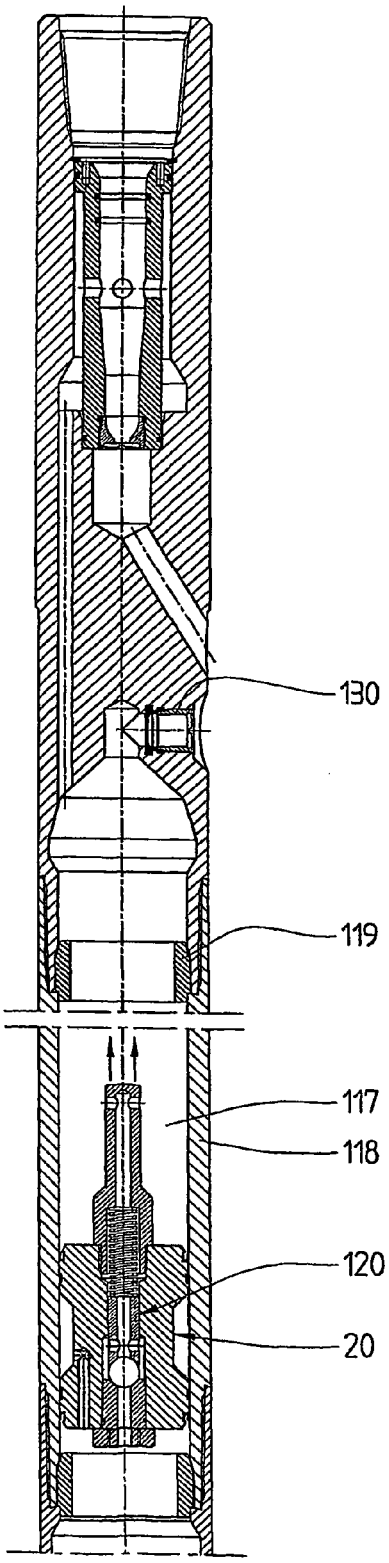

In the position illustrated in FIG. 18, the fluid supplied exerts an upward pressure on one of the surfaces of the piston 20, whilst the other surface is at atmospheric pressure, since no fluid has yet been injected into the pipe string. The piston is therefore driven upwards as soon as the product of this pressure and the first surface of the piston overcomes the resistance of the friction of the seals between the piston 20 and the external wall 118 of the chamber 117.

In the top position, the piston 20 can abut against the stop 119 and even cause a detachment of the non-return valve 120, thus allowing a drainage of the bottom compartment of the chamber 117.

Figure 16:
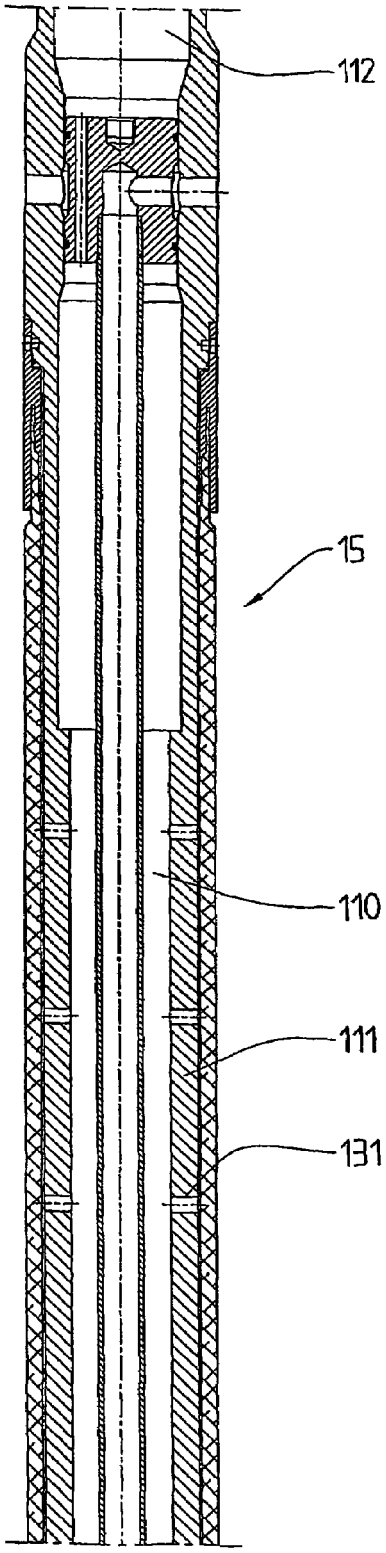
Figure 15:
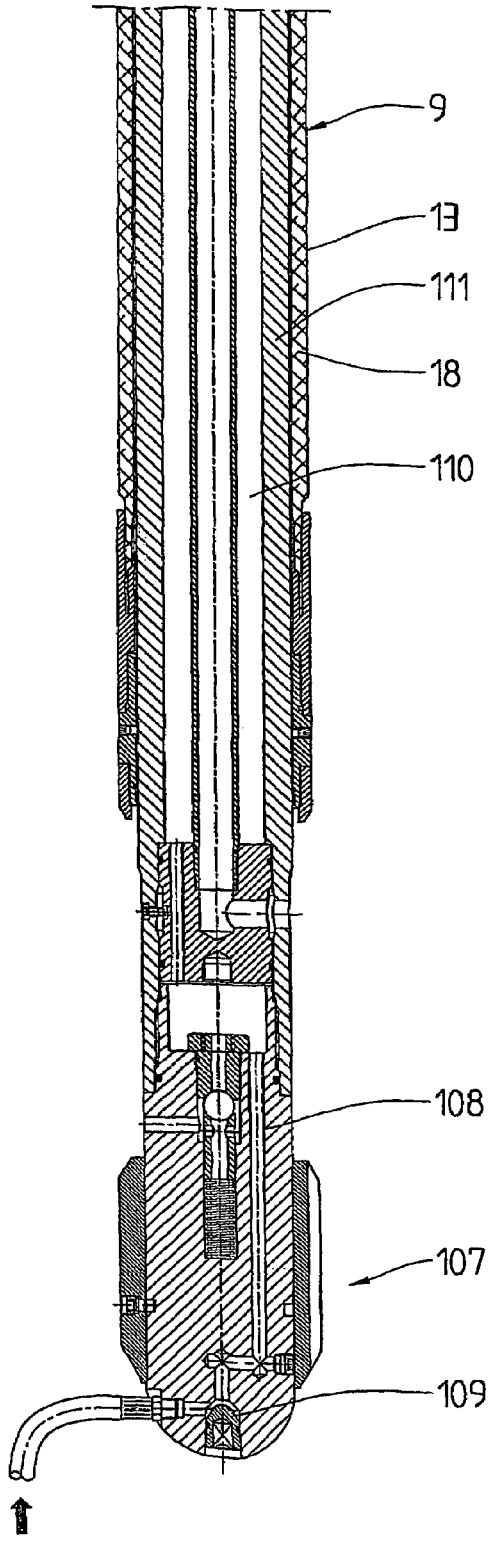

As can be seen in FIG. 16, the annular cavity 110 has outlet conduits 131 oriented radially towards the internal lateral surface 12 of the expansible device. However, the pressure applied to the liquid supplied, which will serve as an expansion liquid, it is not sufficient to overcome the inherent resistance of the expansible device 9 to an expansion.

In FIGS. 19 to 22, the assembly according to the invention has been lowered into the borehole and the expansible device 9 is being expanded.

The cock 109 has been closed.

Figure 22:
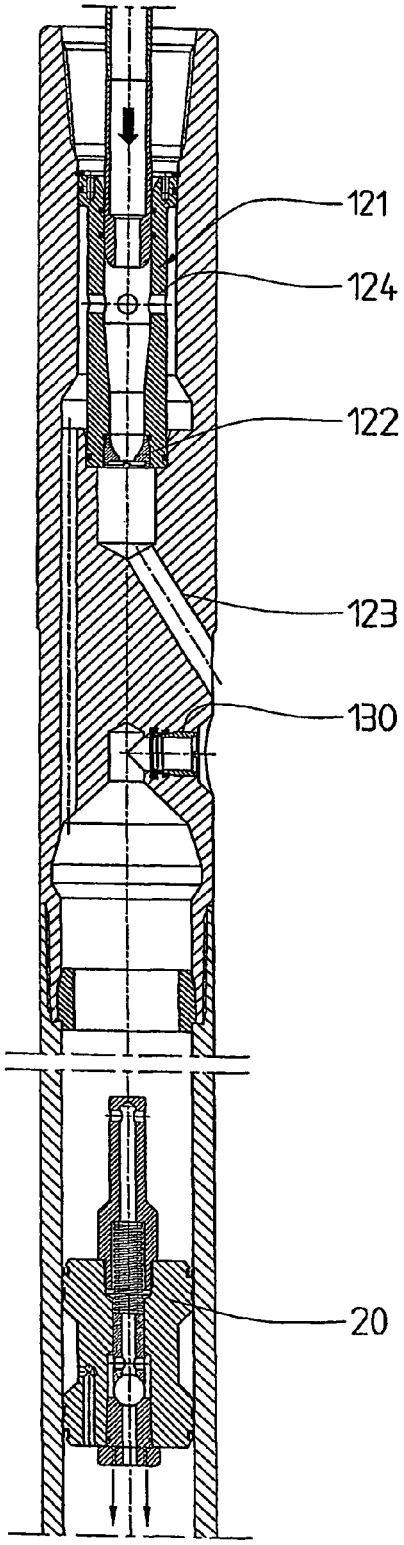

As is clear from FIG. 22, the removable tubing 39, as described in the embodiment illustrated in FIGS. 1 to 14, is pressed in a sealed manner in one end of the tubular throttling element 121. At its end, this throttling element 121 is provided with a strangler 122 which puts the cavity of the throttling element in communication with the borehole through an outlet pipe 123 and which causes an increase in pressure upstream.

Upstream of the strangler, in the direction of flow of the fluid of the drilling fluid type brought by the removable tubing 39, the throttling element 121 is provided with small orifices 124 which are directed radially outwards and thus enable part of the drilling or coring fluid to reach the compartment in the chamber 117 which is situated opposite to the one receiving the expansion fluid.

The throttling element 121 therefore separates the pressurized drilling fluid into two streams, a main stream at high flow which is discharged in to the borehole and a secondary stream at low flow which serves to act on the separation piston 20. When the product of the pressure of the drilling fluid and the surface area of the separation piston 20 is greater than the sum of the pressure of the expansion fluid multiplied by the surface area of the separation piston 20 and the friction of the separation piston 20 on the internal wall 118 of the chamber 117, the piston is moved downwards.

In the bottom position, the piston 20 comes into abutment against the stop 125.

Figure 21:
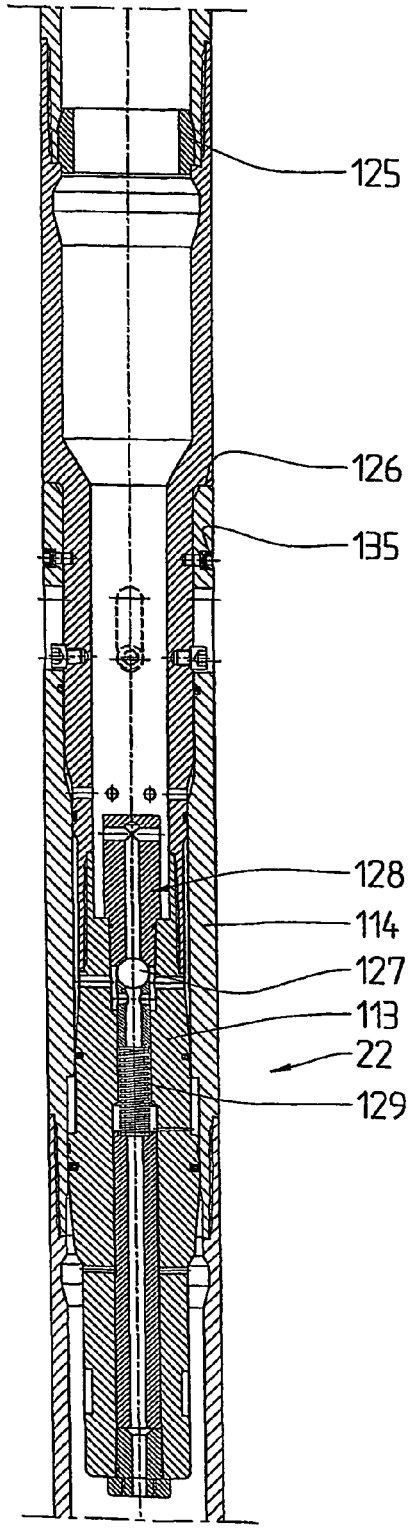
Figure 24:
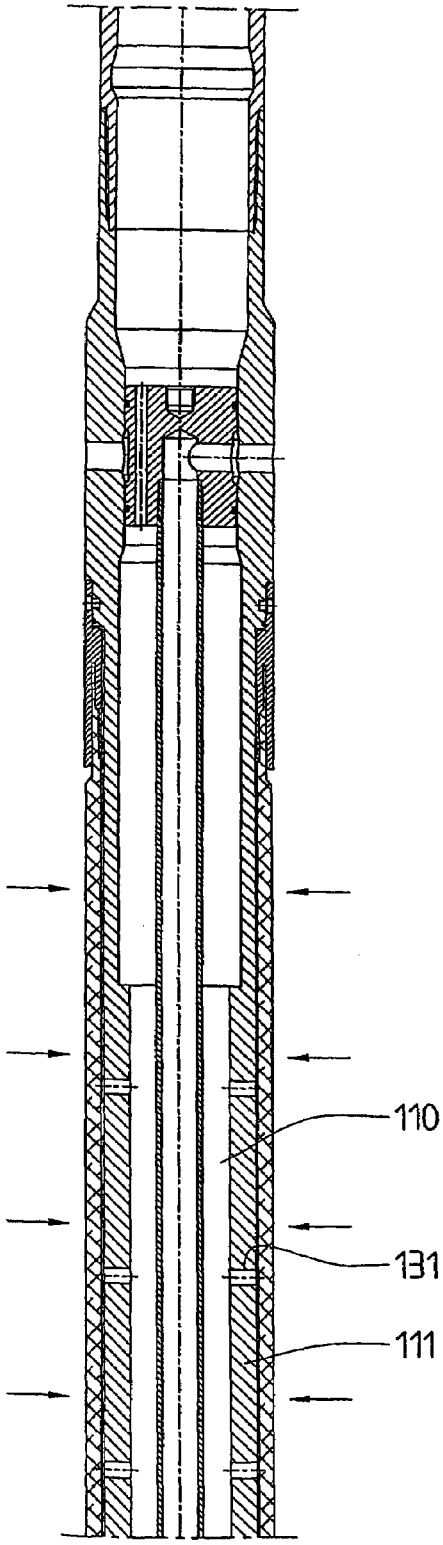
Figure 23:
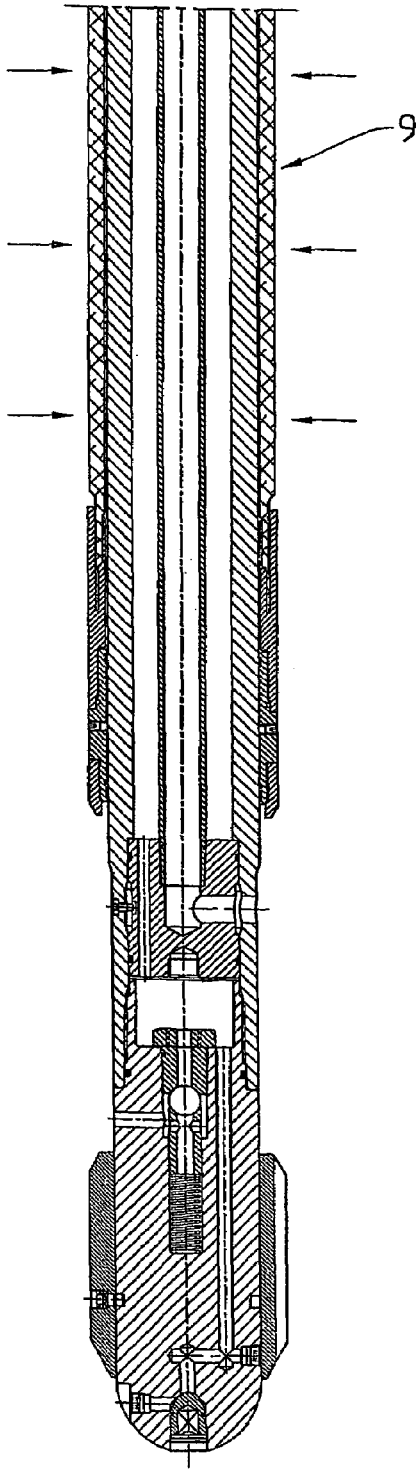

In the bottom position of the drilling or coring assembly according to the invention, the second part 114 of the retaining valve 22 has been immobilized in the borehole by known means. The first part 113 is then lowered by sliding into the second part 114 and, as illustrated in FIG. 21, the first part 113 in the bottom position bears on the seat 126 of the tubular part 114. In this position, the valve 22 closes off any passage of expansion fluid from the cylindrical cavity 112 to the chamber 117 of the separation piston 20.

In this position also, the radial holes 132 provided in the second part 114 of the retaining valve 22 come to be housed facing the radial holes 133 of a support tube 134 of the first part 113 of the valve 22. By known means, shearing screws are then passed through these holes 132 and 133 so as to immobilize any movement of the second part 114 with respect to the rest of the drilling and coring assembly and therefore with respect to the first part 113.

Figure 20:
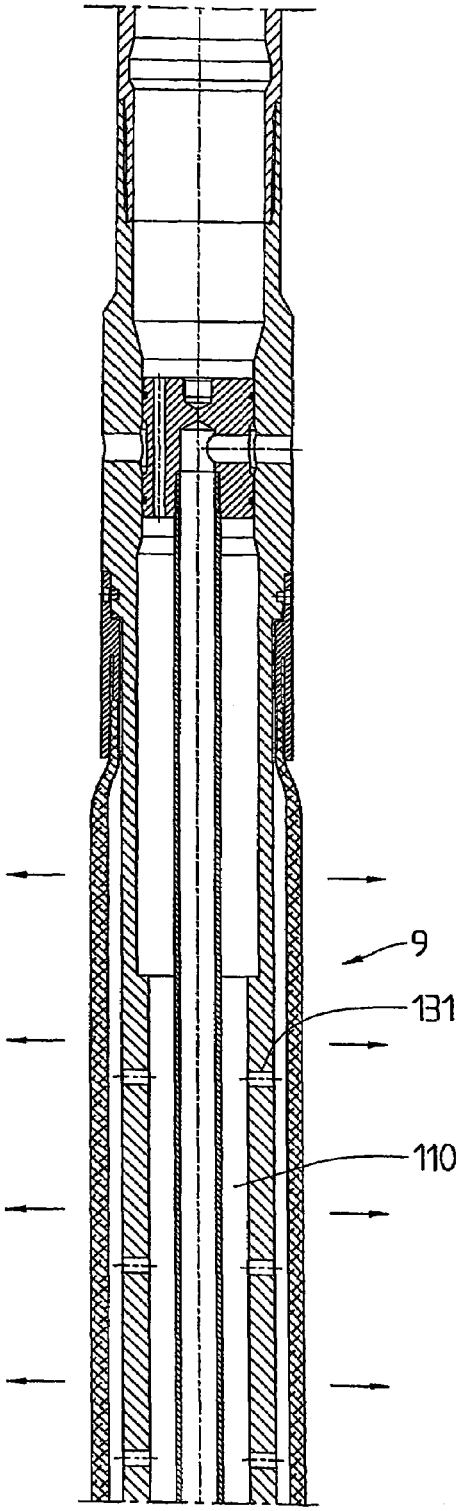
Figure 19:
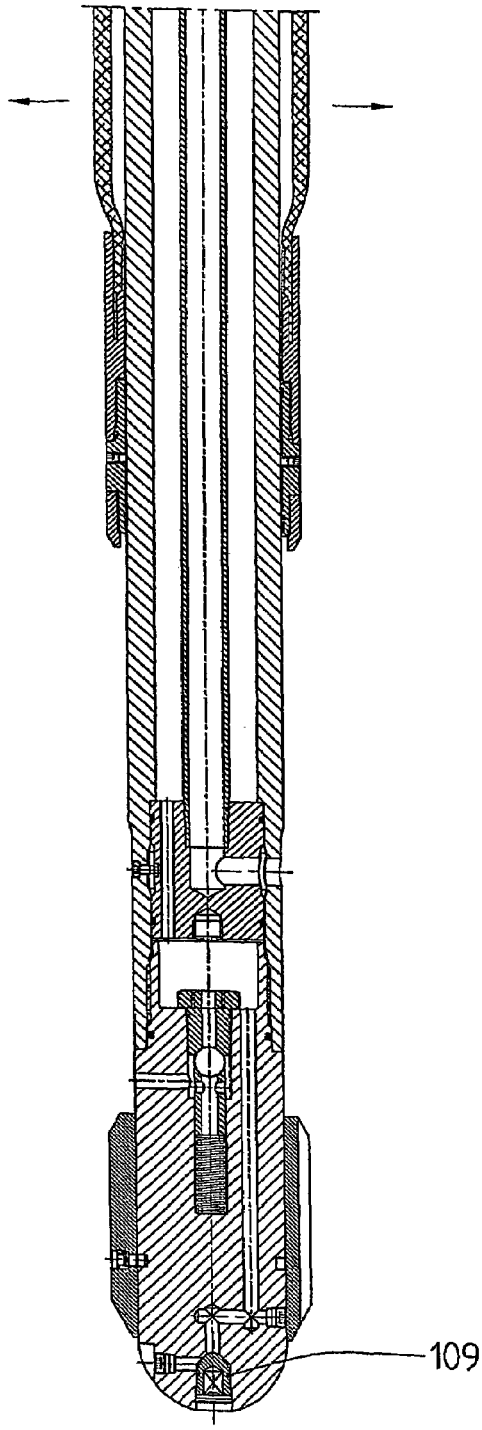

As the pressure of the drilling or coring fluid is high, the pressure of the expansion fluid in the chamber 117 becomes such that it drives downwards the bore 127 of the non-return valve integrated in the retaining valve 22, counter to the return spring 129. A passage of expansion fluid is then permitted from the chamber 117 of the separation piston 20 to the cylindrical cavity 112, where the pressure increases correspondingly. At one moment, the pressure exceeds the given pressure making it possible to overcome the resistance of the expansible device 9. As shown in FIG. 20, the expansible device is then expanded, which allows an immobilization of the assembly according to the invention inside the borehole. the non-return value integrated in the retaining value 22, counter to the return spring 129. A passage of expansion fluid is then permitted from the chamber 117 of the separation piston 20 to the cylindrical cavity 112, where the pressure increases correspondingly. At one moment, the pressure exceeds the given pressure making it possible to overcome the resistance of the expansible device 9. As shown in FIG. 20, the expansible device is then expanded, which allows an immobilization of the assembly according to the invention inside the borehole.

Figure 26:
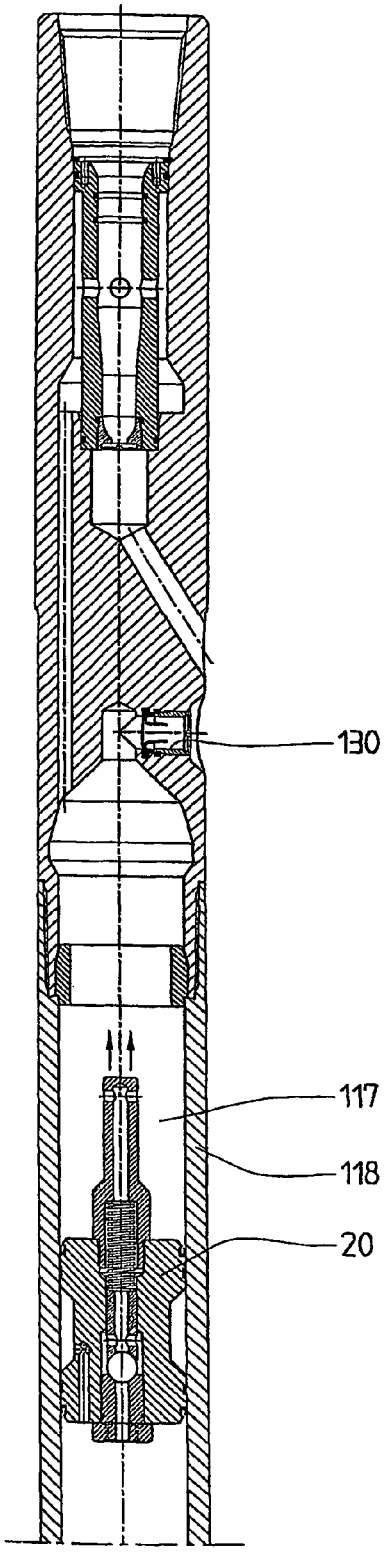

At a given moment, the pressure increases in the chamber 117 to the point that a safety valve 130 breaks and gives access to the outside to the fluid situated in the top compartment of this chamber (see FIG. 26). The supply of pressurized drilling fluid could then be stopped or maintained for the requirements of cleaning the borehole. The expansible device 9 is during this time kept in its expanded position, without the possibly of upward return of the expansion fluid, which is prevented by the retaining valve 22 and the ball 127 of its non-return valve.

In the position depicted in FIGS. 23 to 26, the expansible device must be deflating to allow a movement, in particular a rising, of the drilling or coring assembly according to the invention in the borehole.

The supply of drilling or boring fluid is stopped and the removable tubing 38 (see FIG. 22) is detached and raised again (see FIG. 26).

Figure 25:
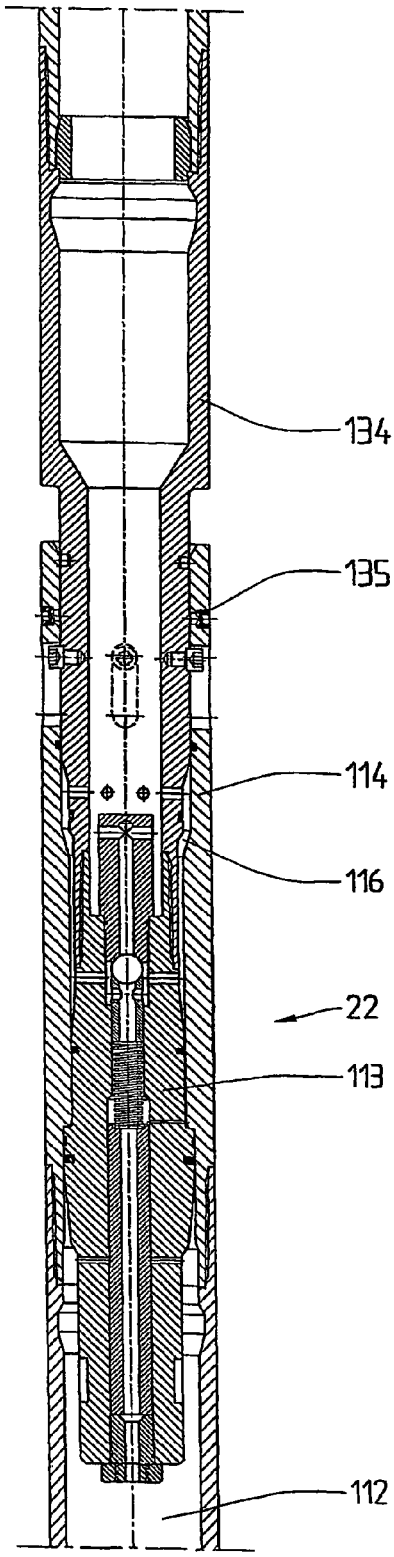

A traction is also exerted upwards on the support tube 134 of the first part 113 of the retaining valve 22. This traction is sufficient to shear the screws 135, as depicted in FIG. 25. The second part 114 of the valve 22 is then released and can slide in its low position, which once again releases a passage 116 from the cylindrical cavity 112 to the cylindrical chamber 117 (as described with regard to FIG. 17).

The product of the pressure of the expansion fluid and the surface area of the separation piston 20 then becomes greater than the sum of the product of the pressure of the drilling or coring fluid remaining in the top compartment of the chamber 117 multiplied by the surface of the separation piston and the friction of the piston 20 against the external wall 118 of this chamber 117. The piston 20 slides upwards and the expansible device 9 returns by elastic return to its initial position in application to the support cylinder 111, which allows the required movement of the drilling or coring assembly.

The latter drilling or coring assembly according to the invention, as illustrated in FIGS. 15 to 26, has the advantage of use, at the retaining valve and the expansible device, of a clean fluid, that is to say without particles in suspension which are a source of fouling of the retaining valve. Moreover, the division of the pressurized drilling fluid stream into main current and secondary current with low flow rate makes it possible to act in a controlled manner on the separation piston, and therefore on the expansible device, without taking account of the drilling fluid flow rate. A separate pumping of drilling fluid during the expansion operation is not necessary, use can be made of the pumping installation required for drilling or coring.

What is claimed is:

1. An assembly for sidetracked drilling in a wall of a borehole previously drilled in a formation comprising:

a guide element:

having an outside diameter chosen so as to be able to enter the borehole to a required depth for sidetracked coring; and having, from a posterior end, in a direction of advance of the drilling towards the bottom of the borehole, a coaxial internal space with a diameter adapted to house a core barrel therein;

an expansible device fixed to the front end of the guide element;

having an external lateral surface that, in an idle state, has a transverse section less than that of the borehole and is arranged to provide, in an expanded state of the expansible device an immobilization abutment against the wall of the borehole; and having a selective actuation means arranged to receive a pressurized fluid for expanding the expansible device and a valve arranged to automatically oppose a discharge of pressurized fluid at a given pressure from the actuation means;

a sidetracking channel formed in the guide element in alignment with an internal space, upstream of the expansible device in the direction of advance, the sidetracking channel having:

a posterior end coaxial with the internal space;

a base and lateral sides following from the posterior end of the channel and in the direction of the expansible device, in a direction inclined with respect to the longitudinal axis of the guide element, the base intercepting the longitudinal axis, the channel extending until it opens out entirely from the guide element, on the other side of the longitudinal axis, at an angle, with respect to the wall, selected for sidetracked drilling; and a transverse section adapted such that the core barrel is guided by the base and the lateral sides can pass therein;

a longitudinal cavity formed in the guide element parallel to the aforementioned longitudinal axis and arranged to allow passage from the internal space to the actuation means of the expansible device;

in the internal space of the guide element, an external tube of the core barrel including a core bit fixed to the front end of the external tube;

the core bit operable to be suspended from a drill string and releasably locked with the guide element, such that the bit is included within an external envelope of the guide element;

the core bit arranged operable to slide, after having been released, in the internal space and in the sidetracking channel and then progress to the formation;

the external tube of the core barrel temporarily disposed so as to actuate the expansible device, a removable tubing extending from the inside of the external tube, through the longitudinal cavity, to the selective actuation means, and which comprises:

a posterior end open to allow the pressurized fluid from the drill string to pass therein;

an attachment piece fixed to the posterior end and arranged for a subsequent withdrawal of the tubing;

a front end arranged for releasable and sealed connection between the tubing and the selective actuation means and operable to communicate the pressurized fluid therethrough; and in the external tube, after having expanded the expansible device and having withdrawn the said tubing out of the assembly, an internal tube of the core barrel arranged such that the core bit is operable to drill, the internal tube of the bit top having an attachment piece fixed to its posterior end and arranged for its descent and subsequent removal.

2. The drilling assembly of claim 1, wherein the guide element comprises a sliding member and the expansible device comprises a chamber in which the sliding member slides between a first position and a second position, the first position in which the sliding member closes off a discharge passage for the fluid contained at the given pressure in the expanded expansible device and a second position in which the sliding member opens the discharge passage.

3. The drilling assembly of claim 1, wherein the external tube of the core barrel comprises an external abutment face turned towards the upstream side and intended to cooperate with an internal stop face of the guide element turned downstream and against which the abutment face abuts during removal of the external tube from the borehole.

4. The drilling assembly of claim 1, further comprising the external tube of the core barrel held fixed in a releasable manner in the guide element by a pin calibrated to break during a controlled rotation of the external tube in the guide element fixed to the wall of the borehole by the expanded expansible device.

5. The drilling assembly of claim 1, wherein:

the tubing comprises at least one orifice at the same level through its wall; and an annular piston having an internal passage for fluid, mounted sealingly so as to slide in the tubing between a starting position upstream of the at least one orifice, in order to enable fluid to enter the tubing, and a stop position for closing the at least one orifice, the fluid being channeled through the annular piston.

6. The drilling assembly of claim 5, further comprising the annular piston held in the starting position by a breakable element calibrated so as to break under a thrust of the piston subjected to a pressure beyond a selected threshold.

7. The drilling assembly of claim 5, wherein the tubing comprises:

a valve seat associated with the annular piston on the upstream side adapted to receive a valve for closing off at least one large fluid passage in the tubing in the direction from upstream to downstream, and to leave the passage clear in the downstream to upstream direction; and at least one bypass, having a transverse section reduced with respect to the passage, arranged as a bypass for the valve seat and the valve.

8. The drilling assembly of claim 1, further comprising preventing longitudinal movement of the tubing in the said external tube by providing:

towards the downstream, a positioning stop; and towards the upstream, a releasable bolt mounted on the tubing, automatically locked in the external tube and connected to the attachment piece of the tubing such that it is released when there is a given traction on the attachment piece.

9. The drilling assembly of claim 1, wherein the expansible device comprises a guide nose having a hemispherical front end.

10. The drilling assembly of claim 1, further comprising a system for measuring the orientation in the ground and operable to record orientation data for analysis.

11. The drilling assembly of claim 10, characterized wherein the measuring system is disposed in the guide nose.

12. The drilling assembly according to claim 10, further comprising the measuring system associated with the posterior removable tubing.

13. The drilling assembly of claim 1, further comprising the actuation means arranged to receive a pressurized drilling fluid.

14. The drilling assembly of claim 1, further comprising the actuation means arranged to receive an expansion fluid pressurized by means of a separation piston.

15. The drilling assembly of claim 14, further comprising a throttling element formed where the removable tubing opens and operable to pressurize drilling fluid and divide the pressurized fluid into a main flow passing through the throttling element towards the inside of the borehole and a secondary stream, having a lower flow rate than the main stream, that serves as a pressurized fluid for pressurizing the expansion fluid.

16. The drilling assembly of claim 15 wherein:

the separation piston slides in a sliding chamber of the actuation means between two extreme positions and has a first surface for contacting the drilling fluid and a second surface for contacting the expansion fluid;

the separation piston slides in a first direction towards a first extreme position when the product of the pressure of the expansion fluid multiplied by the surface area of the second surface area is greater than the sum of the product of the pressure of the drilling fluid multiplied by the surface area of the first surface and the friction between the separation piston and the sliding chamber; and the separation piston slides in a second direction towards the second extreme position when the product of the pressure of the drilling fluid and the first surface area is greater than the sum of the product of the pressure of the expansion fluid multiplied by the second surface area and the friction between the separation piston and the sliding chamber; and during the sliding of the separation piston in the first direction, the expansion fluid does not attain pressure beyond which an expansion of the expansible device takes place and during the sliding of the separation piston in the second direction, the expansion fluid attains a sufficient pressure for causing an expansion of the expansible device.

17. An assembly for sidetracked drilling, in a wall of a borehole previously drilled in a formation comprising:

a guide element;

an expansible device fixed to the front end of the guide element operable to be selectively expanded by an actuation means;

a sidetracking channel formed in the guide element in alignment with an internal space, upstream of the expansible device in the direction of advance;

a longitudinal cavity formed in the guide element parallel to the longitudinal axis and arranged to allow passage from the internal space to the actuation means of the expansible device;

in the internal space of the guide element, an external tube of the core barrel including a core bit fixed to the front end of the external tube;

the core bit arranged operable to slide, after having been released, in the internal space and in the sidetracking channel and then progress to the formation;

the external tube of the core barrel configured to direct drilling fluid to actuate the expansible device;

wherein the expansible device further comprises:

an external lateral surface that, in an idle state, has a transverse section less than that of the borehole and is arranged to provide, in an expanded state of the expansible device an immobilization abutment against the wall of the borehole; and a selective actuation means arranged to receive a pressurized fluid for expanding the expansible device and a valve arranged to automatically oppose a discharge of pressurized fluid at a given pressure from the actuation means.

18. An assembly for sidetracked drilling, in a wall of a borehole previously drilled in a formation comprising:

a guide element;

an expansible device fixed to the front end of the guide element operable to be selectively expanded by an actuation means;

a sidetracking channel formed in the guide element in alignment with an internal space, upstream of the expansible device in the direction of advance;

a longitudinal cavity formed in the guide element parallel to the longitudinal axis and arranged to allow passage from the internal space to the actuation means of the expansible device;

in the internal space of the guide element, an external tube of the core barrel including a core bit fixed to the front end of the external tube;

the core bit arranged operable to slide, after having been released, in the internal space and in the sidetracking channel and then progress to the formation;

the external tube of the core barrel configured to direct drilling fluid to actuate the expansible device;

wherein the sidetracking channel further comprises:

a posterior end coaxial with the internal space;

a base and lateral sides following from the posterior end of the channel and in the direction of the expansible device, in a direction inclined with respect to the longitudinal axis of the guide element, the base intercepting the longitudinal axis, the channel extending until it opens out from the guide element, on another side of the longitudinal axis, at an angle, with respect to the wall, selected for sidetracked drilling; and a transverse section adapted such that the core barrel is guided by the base and the lateral sides can pass therein.

19. A method for sidetracked drilling, in a wall of a borehole previously drilled in a formation comprising:

providing a guide element;

providing an expansible device fixed to the front end of the guide element operable to be selectively expanded by an actuation means;

forming a sidetracking channel in the guide element in alignment with an internal space, upstream of the expansible device in the direction of advance;

forming a longitudinal cavity in the guide element parallel to the longitudinal axis and arranged to allow passage from the internal space to the actuation means of the expansible device;

providing in the internal space of the guide element, an external tube of a core barrel including a core bit fixed to the front end of the external tube, the core bit arranged operable to slide, after having been released, in the internal space and in the sidetracking channel and then progress to the formation;

actuating the expansible device from the external tube of the core barrel;

wherein providing the expansible device further comprises providing:

an external lateral surface that, in an idle state, has a transverse section less than that of the borehole and is arranged to provide, in an expanded state of the expansible device an immobilization abutment against the wall of the borehole; and a selective actuation means arranged to receive a pressurized fluid for expanding the expansible device and a valve arranged to automatically oppose a discharge of pressurized fluid at a given pressure from the actuation means.

20. An assembly for sidetracked coring, in a wall of a borehole previously drilled in a formation comprising:

a guide element;

an expansible device fixed to the front end of the guide element operable to be selectively expanded by an actuation means;

a sidetracking channel formed in the guide element in alignment with an internal space, upstream of the expansible device in the direction of advance;

a longitudinal cavity formed in the guide element parallel to the longitudinal axis and arranged to allow passage from the internal space to the actuation means of the expansible device;

in the internal space of the guide element, an external tube of the core barrel including a core bit fixed to the front end of the external tube, the external tube of the core barrel configured to direct drilling fluid to actuate the expansible device;

the external tube fixed to the guide element, the external tube releasable from the guide element by a selected motion of the external tube with respect to the guide element; and after having been released, the external tube and the core bit operable to descend in the sidetracking channel and progress to the formation.

21. The assembly of claim 20 wherein the selected motion for releasing the external tube from the guide element comprises a rotation of the external tube with respect to the guide element.

22. The assembly of claim 20 wherein the selected motion for releasing the external tube from the guide element comprises a translation of the external tube with respect to the guide element.

23. The assembly of claim 20 wherein the selected motion for releasing the external tube from the guide element comprises a combination of rotation and translation of the external tube with respect to the guide element.

24. The assembly of claim 20 further comprising a pin protruding from the guide element and extending into the external tube, the pin sized to break under the load of the selected motion of the external tube with respect to the guide element.

25. The assembly of claim 20 further comprising a drill bit top extendable through an interior portion of the core bit, the configuration of the core bit and drill bit top forming a drilling head.

* * * * *